United States Patent [19]

Matsuhisa et al.

[11] 4,275,969

[45] Jun. 30, 1981

[54] PRINTING MACHINE

[75] Inventors: Koh Matsuhisa, Kanagawa; Mamoru Takezawa, Yokohama, both of Japan

[73] Assignee: Ricoh Company, Ltd., Japan

[21] Appl. No.: 974,099

[22] Filed: Dec. 28, 1978

[30] Foreign Application Priority Data

| | | | |
|---|---|---|---|
| Dec. 28, 1977 | [JP] | Japan | 52-157476 |
| Dec. 28, 1977 | [JP] | Japan | 52-175949[U] |
| Dec. 28, 1977 | [JP] | Japan | 52-175951[U] |

[51] Int. Cl.[3] ..... B41J 13/036; B41J 13/10

[52] U.S. Cl. ..... 400/625; 400/629; 400/639.1; 400/602; 400/642; 400/647.1; 271/164

[58] Field of Search ..... 271/4, 127, 164; 400/624, 625, 613, 629, 639.1, 639.2, 602, 637.1, 636.1, 627, 642, 647, 647.1, 692

[56] References Cited

U.S. PATENT DOCUMENTS

| | | | |
|---|---|---|---|
| 1,503,069 | 7/1924 | Smith | 400/647.1 |
| 1,564,937 | 12/1925 | Campbell | 400/627 |
| 1,988,189 | 1/1935 | Dobson | 400/637.1 |
| 2,094,011 | 9/1937 | Helmond | 400/637.1 |
| 2,366,206 | 1/1945 | Metzner | 400/629 |
| 2,528,420 | 10/1950 | Carroll et al. | 400/627 |
| 3,586,317 | 6/1971 | Smitzer | 271/127 |
| 3,806,112 | 4/1974 | Melby et al. | 271/164 |
| 4,032,137 | 6/1977 | Katayama et al. | 271/164 |
| 4,067,566 | 1/1978 | Williams | 400/625 |
| 4,113,244 | 9/1978 | Rnenzi | 271/127 |

OTHER PUBLICATIONS

Garrison et al., Cartridge Sheet Feed, IBM Technical Disclosure Bulletin, vol. 21, No. 12, p. 4753, 5/79.

Klein et al., Snap-on Paper Handing Apparatus, IBM Technical Disclosure Bulletin, vol. 19, No. 7, pp. 2395–2396, 12/76.

*Primary Examiner*—William Pieprz

*Attorney, Agent, or Firm*—McGlew and Tuttle

[57] ABSTRACT

A printing machine, such as a typewriter, printer, etc., including a platen having wound thereon a sheet for printing characters and symbols thereon and provided with an automatic sheet feeding apparatus including a cassette containing a plurality of sheets automatically fed to the platen. The cassette can be inserted into or withdrawn from the sheet feeding apparatus through an opening in the front of the sheet feeding apparatus. The sheet feeding apparatus enables a sheet to be selectively fed manually, if desired, besides enabling sheets to be fed automatically from the cassette. The sheet feeding apparatus enables a paper bail to be mechanically operated in conjunction with its operation of automatically feeding sheets to the platen.

8 Claims, 10 Drawing Figures

PRINTING MACHINE

BACKGROUND OF THE INVENTION

In printing machines, it has hitherto been customary to feed sheets manually one by one or, when sheet feeding is mechanized, to pile sheets in a stack in a hopper disposed behind the printing machine, to be successively fed to the printing machine automatically.

In a printing machine, the sheet is moved upwardly to the printing position, and the sheet on which printing has been made is ejected onto a position above the sheet feeding tray, with the result that a sheet receiving tray is located above the sheet feeding hopper. Thus, printing machines of the prior art automatically receiving a supply of sheets have had the disadvantage that it is impossible to readily replenish the sheets on the hopper by supplying them from the front of the machine when the stack of sheets on the hopper are reduced in number.

In a printing machine such as a typewriter, printing means is located on the side of the operator, and a sheet fed from the rear of the machine by way of the lower portion of the machine is moved upwardly in the front of the machine after characters or symbols are printed thereon. Stated differently, the sheet moves along the front of the machine in a printing operation, and guide plates and other elements are located to form a wall, as it were, where a sheet moves. Thus, the idea of supplying sheets to the hopper from the front of the printing machine have not occurred to anyone in the past.

When sheets are supplied to the hopper from the rear or side of the printing machine by keeping clear of the ejected sheet receiving tray located in the front upper portion of the machine, it is necessary to put the sheets in an orderly manner on the hopper in order to ensure that sheet feeding is carried out satisfactorily. It is a timeconsuming operation to put loose sheets are skewed or not located in the correct position on the hopper.

When sheet feeding is carried out automatically, a portion for supporting sheets to be fed is disposed in a lower position and a portion for receiving sheets after being printed is disposed in a higher position. A guide plate or other means will naturally be used for guiding sheets from the platen to the ejected sheet receiving portion. Automation of sheet feeding makes such structure necessary, and consequently it becomes impossible to manually feed one sheet to the platen when it is required to produce only one copy or it is desired to run the printing machine for test. Even if it is not impossible to do so, the operation would be troublesome because detaching of some part from the apparatus would have to be effected.

In a printing machine, a sheet is passed along the platen and moved upwardly from below in front of the printing head before being wound on the platen. The sheet would on the platen is not held stably unless a portion of the sheet above the printing head is kept close to the platen. To this end, the sheet would on the platen is generally held against the platen by means of a paper bail. However, the paper bail interferes with an operation of inserting a sheet. To eliminate this disadvantage, a paper bail arm supporting the paper bail has hitherto been moved manually. More specifically, when a sheet is inserted, it has been customary to move the paper bail away from the platen and to move the paper bail toward the platen upon completion of insertion of the sheet, to make the printing machine ready for a printing operation.

The advent of automation of a sheet feeding operation in a printing machine has created a demand for automatically moving the paper bail toward and away from the platen so as to avoid its interfering with the insertion of a sheet.

SUMMARY OF THE INVENTION

An object of this invention is to provide a printing machine having an automatic sheet feeding apparatus capable of positively feeding sheets by a simple operation.

Another object of the invention is to provide a printing machine to which sheets can be readily fed by the operator who remains in a sitting position.

This device has as its object the provision of a printing machine which enables both automatic and manual sheet feeding to be carried out by a simple construction.

This device has as its object the provision of a system for automatically actuating a paper bail with a predetermined timing with respect to the feeding of a sheet.

Proposals have hitherto been made to automatically actuate a paper bail. If the actuation of a paper bail is mechanically carried out, there arises a problem that it is impossible to manually actuate the paper bail when it is desired to do so. Also, another problem encountered is that a printing machine commercially available in the market cannot be remodelled into a machine of the automatically actuated paper bail type.

This device solves the problems of the prior art machines and provides a system which enables both automatic and manual actuation of a paper bail to be readily performed selectively and which can be applied to a printing machine which is commercially available in the market.

DESCRIPTION OF THE PREFERRED EMBODIMENTS

Figure 1:
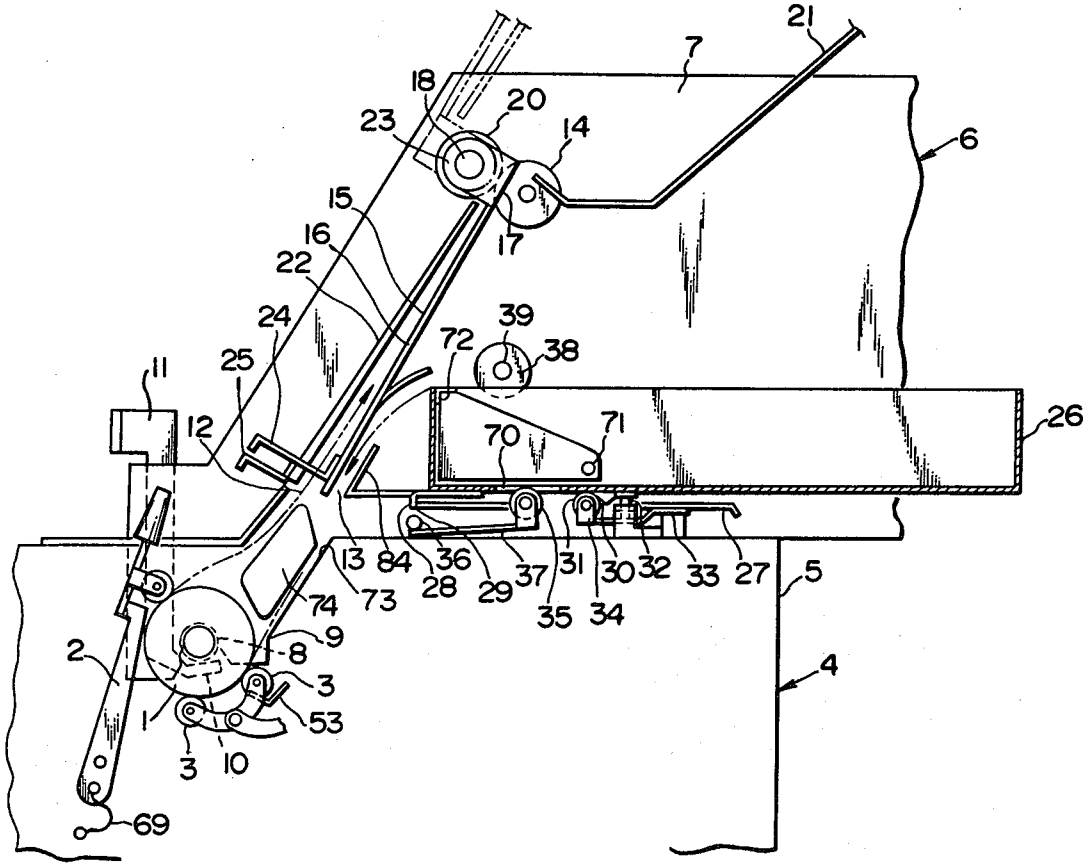
FIG. 1 is a side view of an apparatus according to the invention.
Figure 2:
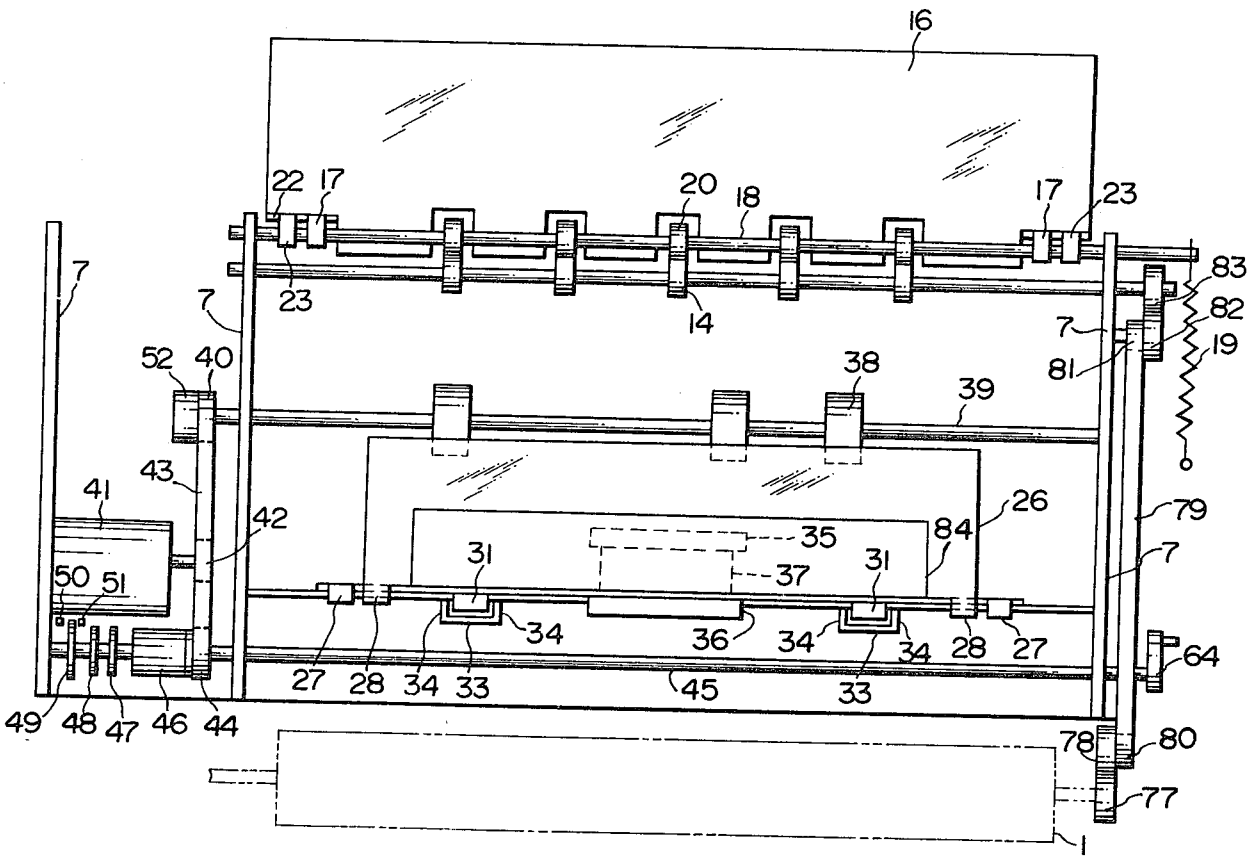
FIG. 2 is a front view.
Figure 3:
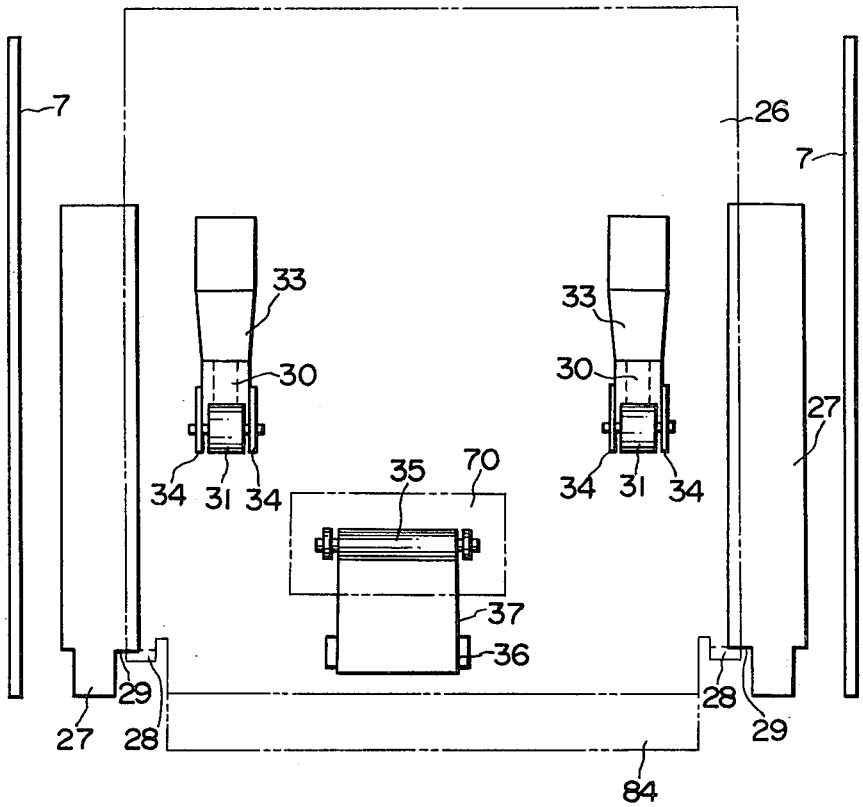
FIG. 3 is a plan view of the cassette mounting section.

The invention will be described in detail by referring to the embodiments shown in the drawings. In FIGS. 1 to 3, a frame 7 an automatic sheet feeding apparatus 6 is mounted on a frame 5 of a printing apparatus 4, such as an automatic typewriter, rotatably supporting a platen 1 and including a paper bail 2 for forcing a sheet against the platen 1 and pressing rollers 3 for pressing the sheet against the platen 1 for moving the sheet. The frame 7 has attached thereto legs 9 each formed with a groove 8 fitted over a shaft of the platen 1 of the printing apparatus. The positioning of the automatic sheet feeding apparatus 6 is effected by means of the legs 9. Each leg 9 has a claw 10 attached to a pin 11 pivotally connected to the leg, so that the legs 9 are moved between a locked position in which the legs 9 grip the shaft of the platen 1 by means of the grooves 8 and the claws 10 and a released position in which the legs 9 are released from engagement with the shaft of the platen 1 through the grooves 8. The claws 10 can be moved either directly by means of levers, for example, or indirectly through a suitable linkage.

The frame 7 of the automatic sheet feeding apparatus 6 has connected thereto a guide plate 16 pivotally supported through brackets 17 by a shaft 18 supported by the frame 7. The guide plate 16 has on its upper and lower surfaces a guide surface 13 for a sheet 12 fed to the platen 1 and a guiding surface 15 for the sheet 12 discharged from the platen 1 and moved to a sheet ejected roller 14 rotatably supported by the frame 7. The sheet ejected while being guided by the guide plate 16 is moved by the sheet ejecting roller 14 and a keep roller 20 pressed against the sheet ejecting roller 14 by springs 19 (See FIG. 4) and ejected onto an ejected sheet receiving tray 21 detachably attached to the frame 7.

An outer guide plate 22 is located above the guide plate 16 in slightly spaced relationship, in order to prevent the deflection of the sheet guided by the guide plate 16 from its path of movement to the sheet ejecting roller 14. Like the guide plate 16, the outer guide plate 22 is pivotally supported by the shaft 18 through brackets 23. The construction can be simplified if the shaft 18 serves concurrently as a shaft of the keep roller 20. The guide plate 16 and the outer guide plate 22 have attached thereto handles 24 and 25 respectively. If the handles 24 and 25 are gripped and the guide plate 16 and outer guide plate 22 are flipped upwardly, then a space extending from the frame 5 of the printing machine 4 to the sheet ejecting roller 14 is opened. That is, a front opening is provided to the automatic sheet feeding apparatus 6.

A cassette 26 containing a predetermined number of sheets is inserted through the front opening of the automatic sheet feeding apparatus 6 and placed in a predetermined position in the apparatus 6.

Upon the guide plate 16 and outer guide plate 22 being flipped downwardly following the placing in place of the cassette 26, the sheet feeding apparatus 6 is ready for feeding sheets to the printing machine 4.

When the cassette 26 is mounted on the apparatus 6 or removed therefrom, it moves in sliding motion along a path on a plate 27 secured to the frame 7. The cassette 26 has positioning teeth 28 formed on its underside, which are adapted to come into engagement with a stop edge 29 formed in the plate 27. When the cassette 26 moving in sliding motion on the plate 27 stopped as the positioning teeth 28 engages the stop edge 29, the cassette 26 has reached its proper position in the sheet feeding apparatus 6. If the cassette 26 is readily moved as by vibration, there are possibilities that the cassette 26 is displaced from its proper position. In order to prevent this phenomenon, the cassette 26 is provided at its underside with a projection 30 having a triangular inclined surfaces, and the frame 7 is provided with a cassette movement preventing roller 31 for applying pressure to the projection 30 when the cassette 26 is positioned in its proper position. A screw 32 for permitting the height of the movement preventing roller 31 to be adjusted is provided in order to prevent the underside of the cassette 26 from striking the roller 31 and making insertion of the cassette 26 impossible, when the cassette 26 is set in position. Cooperating with the projection 30, the movement preventing roller 31 functions to force the cassette 26 to move rearwardly at all times, to keep the positioning teeth 28 of the cassette 26 in pressing engagement with the stop edge of the plate 27, thereby keeping the cassette 26 in its proper position.

The movement preventing roller 31 is rotatably supported by a lug 34 formed in a plate spring 33 secured to the frame 7 and is moved downwardly by the projection 30 when a high force is exerted thereon as when the cassette 26 is inserted or pulled out, to permit the cassette 26 to move along the plate 27. However, the projection 30 is engaged by the movement preventing roller 31 to prevent movement of the cassette 26, even if the apparatus 6 vibrates or a low force is exerted on the roller 31.

The frame 7 has secured thereto a push-up roller 35 which is disposed below the cassette 26. The push-up roller 35 is rotatably supported by a resilient support plate 37 attached to a shaft 36 secured to the frame 7. The support plate 37 is operative to force the sheets in the cassette 26 against feed rollers 38 even if there is only one sheet in the cassette 26. If necessary, a spring may be used for increasing the biasing force of the support plate 37.

Figure 4:
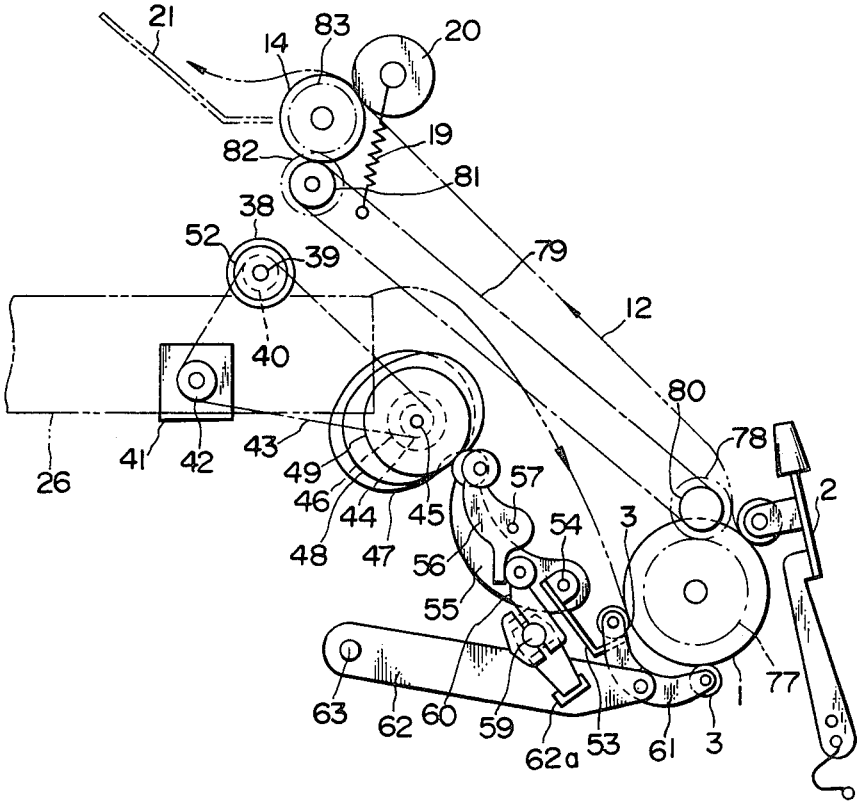
FIG. 4 is a view in explanation of the main drive system.

The feed rollers 38, which are mounted above the cassette 26 near the forward end thereof, are rotatably supported by a shaft 39 connected to the frame 7 and having a pulley 40 secured thereto through an electromagnetic clutch 52 as shown in FIGS. 2 and 4. A timing belt 43 is trained over the pulley 40 and another pulley 42 secured to an output shaft of a motor 41 to drive the pulleys 40 and 42 in unison. The timing belt 43 is also trained over another pulley 44 which is rotatably connected to a crank shaft 45 rotatably supported by the frame 7. The crank shaft 45 and the pulley 44 are engaged and disengaged by one-rotation clutch 46. The pulley 44 which has secured thereto a first cam plate 47, a second cam plate 48 and a detecting plate 49 is rotated together with the pulley 44. A light emitting element 50 and a light receiving element 51 are located on opposite sides of the detecting plate 49 and the amount of rotation of the detecting plate is detected and converted into an electric signal.

The first cam plate 47 is tracked, as shown in FIG. 4, by a stopper arm 55 secured to a shaft 54 to act as a cam follower and having a stopper pawl 53 attached thereto. The stopper arm 55 and stopper pawl 53 pivotally move about the shaft 34 as a unit.

The second cam plate 48 is tracked by a pressure arm 56 pivotally supported by a shaft 57 to act as a cam follower. The pivotal movement of the pressure arm 56 about the shaft 57 moves in pivotal movement a release arm 60 secured to a release shaft 59. The release arm 60 moves in pivotal movement about a shaft 63 pressure roller arms 62 which support the pressure rollers 3 through a supporting bar 61, so as to bring the pressure rollers 3 into and out of pressing engagement with the platen 1.

Figure 5:
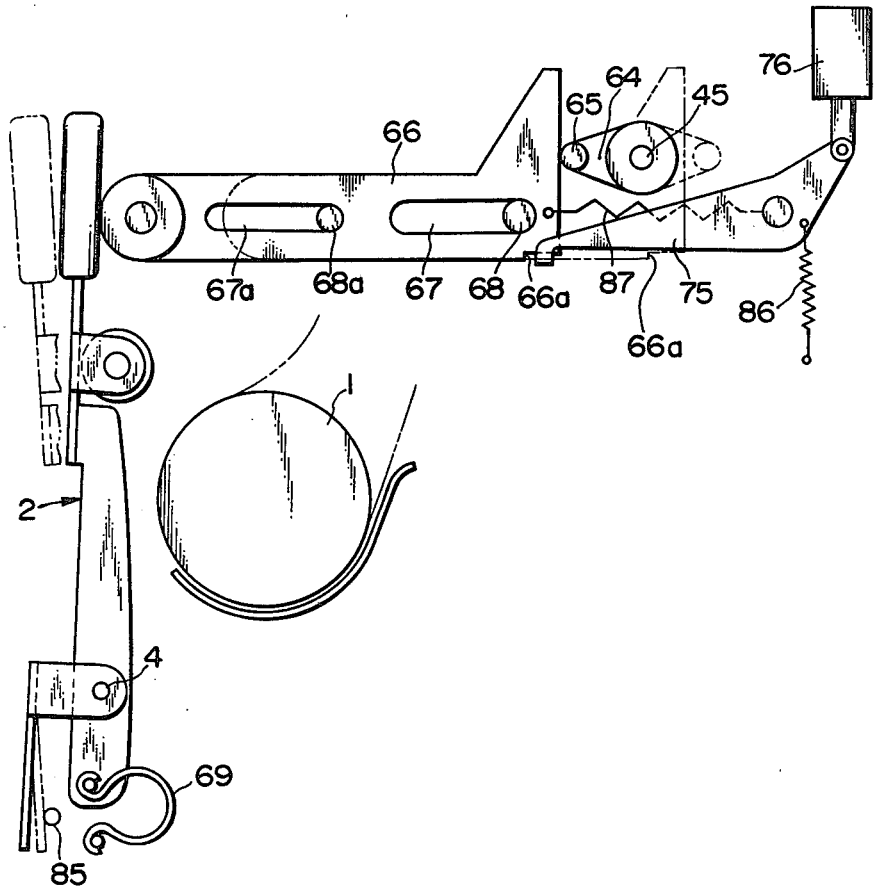
FIG. 5 is a view in explanation of the actuating system for moving the paper bail into and out of its operative position.

As shown in FIG. 5, the crank shaft 45 includes a crank 64 attached thereto and having crank pins 65 attached to the crank 64. One complete revolution of the crank 64 moves a lever 66 in one reciprocating movement. The lever 66 is guided in its reciprocating movement by slots 67 and 67*a* formed in the lever 66 and cooperating with pins 68 and 68*a* attached to the frame 7.

The lever 66 is in abutting engagement at its forward end with an upper end portion of the paper bail 2, and moves the paper bail 2 between an operative position shown in dash-and-dot lines in which the paper bail 2 is in pressing engagement with the platen 1 and an inoperative position shown in solid lines in which the paper bail 2 is released from engagement with the platen 1, as the lever 66 moves in reciprocating movement. The paper bail 2 is subjected to the biasing force of a click spring 69 which holds the paper bail 2 in its operative position and presses the lever 66 when the paper bail 2 is in its inoperative position.

The operation will now be described. When no cassette 26 is mounted on the automatic sheet feeding apparatus 6, the handles 25 and 24 are gripped to flip the outer guide plate 22 and guide plate 15 upwardly as indicated by dash-and-dot lines in FIG. 1. Then the cassette 26 containing a predetermined number of sheets is inserted through the front opening of the sheet feeding apparatus 6.

The cassette 26 moves in sliding movement along the plate 27, and as the projection 30 on the underside of the cassette 26 moves over the movement preventing roller 31 the positioning teeth 38 formed in the cassette 26 are brought into abutting engagement with the stop edge 29 of the plate 27, thereby positioning the cassette in its proper position.

After the cassette 26 is placed in its proper position, the push-up roller 35 is moved upwardly by the resilient support plate 37 through an opening 70 formed in the bottom of the cassette 26, to thereby bring the uppermost sheet in the cassette 26 to the feed rollers 38. Thus the cassette 26 is pushed upwardly by the pushup roller 35 and the uppermost sheet of a stack of sheets in the cassette 26 is brought into pressing engagement with the feed rollers 38.

Following the insertion of the cassette 26 into the sheet feeding apparatus 6, the guide plate 15 and outer guide plate 22 are flipped downwardly, thereby completing a cassette mounting operation.

A signal for feeding a sheet starts the motor 41, and the electromagnetic clutch 52 is engaged after the presence of sheets and other conditions are checked, to rotate the sheet feed rollers 38. The sheets are fed frictionally by the rotation of the feed rollers 38 and only one sheet is separated from the rest of the sheets by the action of corner claws 72 each pivotally supported by a pin 71 attached to the cassette 26, to be delivered to the printing station.

The sheet fed in this way is guided in its movement by the fed sheet guiding surface 13 of the guide plate 15, moves between a guiding surface 73 of the printing machine 4 and a silencer 74, and is brought into abutting engagement with the stopper pawl 53. After a slight time lag following the engagement of the fed sheet with the stopper pawl 53, the electromagnetic clutch 52 is disengaged, thereby stopping the rotation of the feed rollers 38. A solenoid is energized with a predetermined timing as the electromagnetic clutch 52 is engaged, and the one-revolution clutch 46 is engaged to rotate the crank shaft 45 and the first and second cam plates 47 and 48. The rotation of the first cam plate 47 and second cam plate 48 brings the pressing rollers 3 out of engagement with the platen 1 and brings the stopper pawl 53 into engagement with the platen 1. After the lapse of a predetermined period of time following the engagement of the stopper pawl 53 with the platen 1, the leading end of the sheet is brought into abutting engagement with the stopper pawl 53 and the sheet feed rollers 38 stop rotating. Meanwhile the rotation of the crank shaft 45 causes the crank 64 to move the lever 66, thereby bringing the paper bail 2 out of engagement with the platen 1 into an inoperative position in which the paper bail 2 is held as a latch 75 is brought into engagement with a stop edge 66*a* of the lever 66 by the action of a spring 86.

Following the movement of the paper bail 2 to its inoperative position, the pressing rollers 3 force the sheet into pressing engagement with the platen 1 by the action of the first and second cam plates 47 and 48. Thereafter the stopper pawl 53 is released from engagement with the platen 1. Thus the cam plates 47 and 48 and the crank shaft 45 stop rotating after making one complete revolution. In predetermined timed relation to the disengagement of the one-rotation clutch 46, the platen rotates until a leading edge of the sheet slightly passes through a position between the paper bail 2 and the platen 1 and the sheet reaches the position in which it is ready to be printed. Thereafter a solenoid 76 is energized to disengage the latch 75, and the paper bail 2 is restored to its operative position by the biasing force of a spring 87, thereby rendering the printing machine 4 ready for initiating a printing operation.

A printing signal causes the sheet on the platen to be printed according to a program.

The rotation of the platen 1 is transmitted to the sheet ejecting roller 14 by means of gear wheels 77 and 78, a timing belt 79, pulleys 80 and 81 and gear wheels 82 and 83. The sheet on which characters are printed is guided to move between the guide plate 15 and the outer guide plate 22, fed by the sheet ejecting roller 14 and keep roller 20, and ejected onto the ejected sheet receiving tray 21.

A suitable signal is given after completion of printing characters on the sheet or ejection of the printed sheet to engage the electromagnetic clutch 52, and thereafter another sheet feeding operation is carried out automatically as described in detail hereinabove.

When the sheets contained in the cassette 26 mounted on the sheet feeding apparatus 6 are exhausted, the guide plate 16 and outer guide plate 22 are flipped upwardly, and a handle 84 at the forward end of the cassette 26 is gripped by the operator and the cassette 26 is pulled out. Then a fresh cassette 26 is inserted in the apparatus 6 in the same manner as described hereinabove and the aforementioned operations are repeated.

Figure 6:
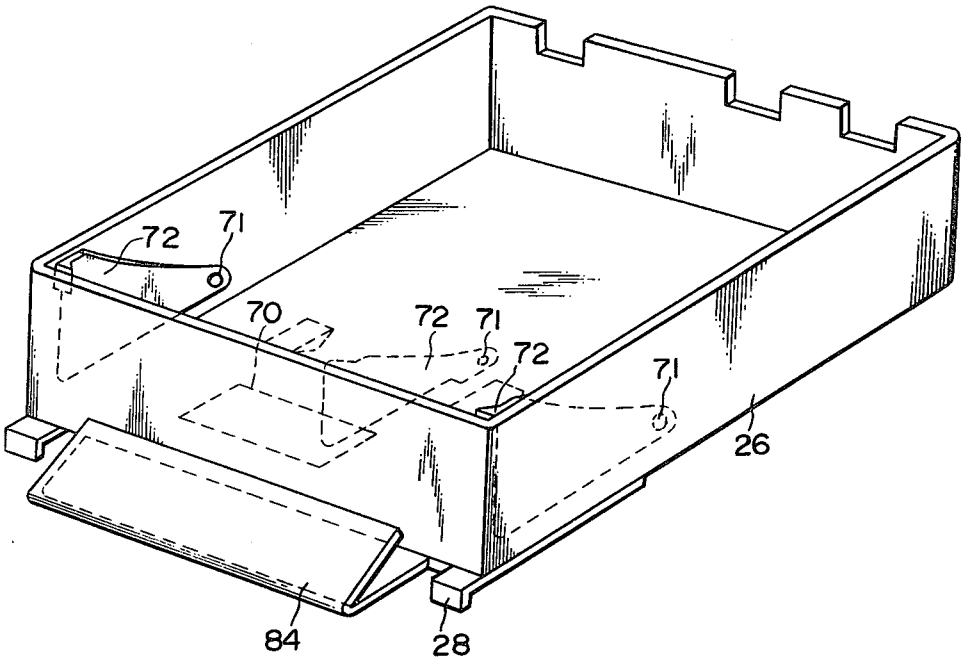
FIG. 6 is a perspective view of one example of the sheet feeding cassette used in the apparatus according to the invention.

The handle 84 of the cassette 26 is advantageously formed as shown in FIG. 6 so that it can also serve as a guiding surface for guiding the sheet 12 to the printing machine 4 from the cassette 26.

The corner claw 72 and other elements are advantageously constructed in such a manner that not only one type of sheets but also two types of sheets of different sizes can be contained in the cassette 26. When this is the case, the sheet feed rollers 38 should naturally be arranged in a manner to allow sheets of different sizes to be fed from the cassette 26 to the printing station.

It is advantageous that the cassette 26 is inserted into the sheet feeding apparatus 6 from the front. However, the invention is not limited to this manner of insertion and the cassette 26' may be inserted into the apparatus from the rear.

Figure 7:
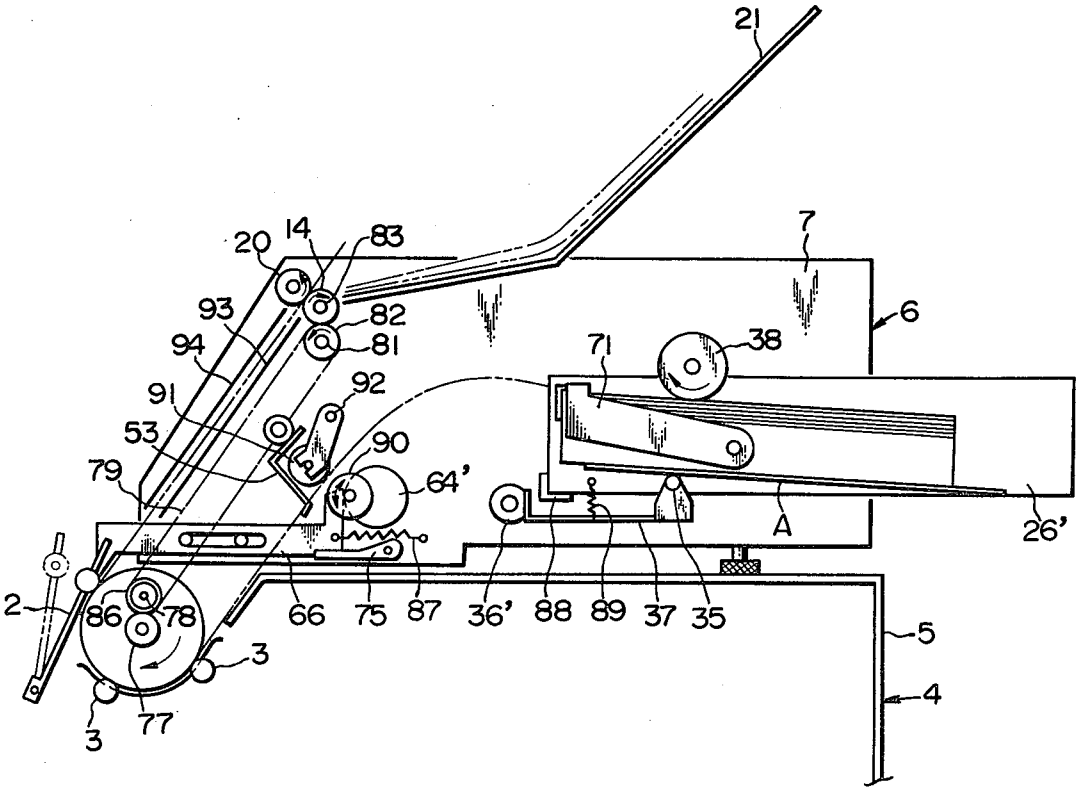
FIG. 7 is a side view of a modification of the sheet feeding apparatus according to the invention in which a cassette is inserted from the rear of the apparatus.

In FIG. 7, like reference characters are used to designate parts similar to those shown in FIGS. 1 to 6.

The sheets contained in the cassette 26' are pressed upwardly into pressing engagement with the sheet feed rollers 38 by the push-up roller 35 supported by the support plate 37 pivotally supported by a shaft 36' and urged to move upwardly by the biasing force of a spring 89.

A sheet feeding signal drives the sheet feed rollers 38 and one sheet after another is separated from the rest of the sheets by the corner claws 72 before being fed to the printing station.

After the lapse of a predetermined period of time following the engagement of the clutch for the feed rollers 38, a solenoid is energized to move the stopper pawl 53 to its operative position, and the sheet fed by the feed rollers 38 abuts against the stopper pawl 53 and has its posture corrected to remove a skew, if there is any, therefrom. At this time, a keep roller 91 is moved away from a feed roller 91 because a solenoid is energized to pivotally move a lever 92 supporting the keep roller 91.

After the lapse of a predetermined period of time following the abutting engagement of the sheet with the stopper pawl 53, therebetween. Then another solenoid is energized to move the stopper pawl 53 away from its operative position, and a one-rotation clutch is energized to rotate the feed roller 90 a predetermined number of times, so as to deliver the sheet 12 to the platen 1. The pressure rollers 3 are moved away from the platen 1 which is rotated.

When the feed roller 90 stops rotating as the one-rotation clutch is disengaged, the leading end of the sheet is fed by the rotation of the platen 1, and the feed roller 90 and the keep roller 91 bite the sheet while remaining stationary, so that the rollers 90 and 91 perform a braking action and prevent the development of a skew in the leading end portion of the sheet. After the lapse of a predetermined period of time, the pressure rollers 3 are brought into pressing engagement with the platen 1, and the keep roller 91 is moved away from the feed roller 90.

While the feed roller 90 is rotating as aforesaid, the lever 66 is moved by the action of a cam 64' supported coaxially as the feed roller 90, to move the paper bail 2 away from the platen 1 to its inoperative position. The latch 75 is engaged to permit the lever 66 to keep the paper bail 2 in its inoperative position.

After the sheet is pressed against the platen and held in this position by the keep rollers 3 and the keep roller 91 is moved apart from the feed roller 90, the platen 1 is rotated through a predetermined angle to move the sheet to a predetermined position and keep the same in this position. Thereafter a solenoid is energized to disengage the latch 75 and move the lever 66 to its original position, so that the sheet is pressed against the platen and kept in this position. Thus the sheet is ready for printing characters thereon.

After characters are printed thereon, the printed sheet is guided by guides 93 and 94 and ejected onto the ejected sheet receiving tray 21 by the sheet ejecting roller 14 rotated in synchronism with the platen 1 as is the case with the embodiment shown in FIG. 1. The aforesaid steps are repeated, and when all the sheets in the cassette are exhausted, the cassette is withdrawn from the rear of the sheet feeding apparatus 6 and a new cassette is inserted, thereby enabling a printing operation to be continuously carried out.

The automatic sheet feeding apparatus for a printing machine according to the invention facilitates the supply of sheets because sheets can be supplied to the printing machine in a stack by using a cassette which contains the sheets therein. The invention enables the cassette to be inserted into the sheet feeding apparatus from the front thereof, thereby facilitating the supply and positioning of the sheets.

Figure 8:
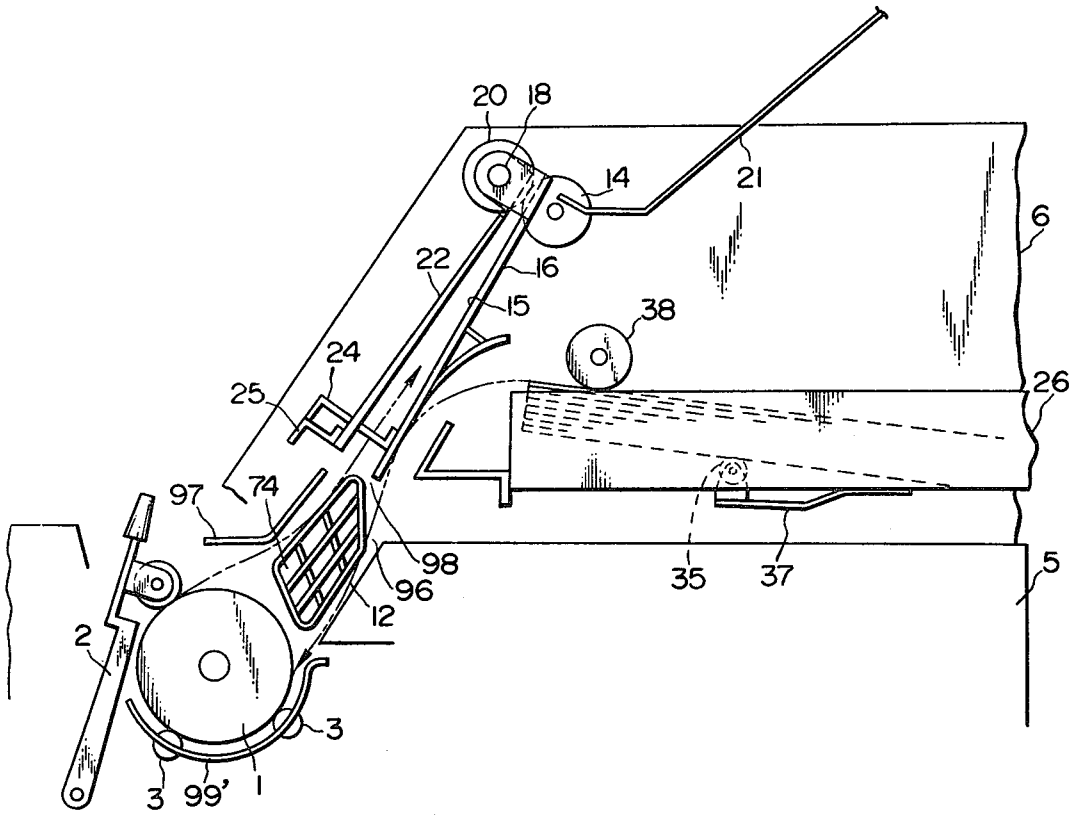
FIG. 8 is a detail of a portion of FIG. 1.

In FIG. 8, an automatic sheet feeding apparatus 6 is mounted on an upper portion of a printing machine, such as a typewriter 5, which includes a platen 1 and a paper bail 2 and in which a sheet 12 supplied is pressed against the platen 1 by pressing rollers 3 so as to guide the sheet to pass along the underside of the platen 1 to move to its front for printing characters thereon. In the automatic sheet feeding apparatus 6 shown in the drawings, the sheets 12 are contained in a cassette 26. The sheets in the cassette 27 are pushed upwardly by a keep roller 35 supported by a resilient bracket 38 and fed one by one by sheet feed rollers 38 as the latter rotate.

A sheet fed from the cassette 26 is guided by a guide plate 16, pivotally supported by a shaft 18 connected to a frame, not shown, of the automatic sheet feeding apparatus. The sheet is further guided by a silencer 74 mounted on the printing machine 5 and led to a sheet introducing opening 96 defined between a frame of the printing machine 5 and the silencer 74. The silencer 74 constitutes a guide portion for the sheet.

The sheet inserted in the sheet introducing opening 96 moves upwardly along the platen 1. When the sheet is inserted, the paper bail 2 is moved away from the platen 1 to facilitate the passing of the sheet. The paper bail 2 is returned to its original position in which it presses against the platen 1, after the sheet has reached a predetermined position.

The sheets successively released from the platen 1 during a printing operation are guided to move between the silencer 74 and a transparent cover 97, and guided by a guiding surface 15 of the guide plate 16 which is opposite to the guiding surface thereof which guides the sheets when the latter are fed from the cassette 26.

The silencer 74 is a member used for reducing noise which would be produced during a printing operation. The silencer 74 serves concurrently as a guide portion, but a separate guide portion may be naturally used in place of the silencer 74.

Each printed sheet guided by the upper surface of the guide plate 16 is bitten by a sheet ejecting roller 14 and a keep roller 20 and ejected onto an ejected sheet receiving portion 21. If the keep roller 20 is supported for rotation by the shaft 18, the shaft 18 can be used for supporting both the guide plate 16 and the keep roller 20. The guide plate 16 is advantageously formed of a transparent material so as to enable observation to be made of the sheet feeding section.

An outer guide plate 22 may be mounted for preventing the deflection of the sheet guided by the guide plate 16 from its path to the sheet ejecting roller 14 due to buckling of the sheet. The outer guide plate 22 is supported by a bracket which is pivotally supported by the shaft 18, and is constructed such that it can be flipped upwardly when sheet feeding is carried out manually. A sheet may be manually inserted in a gap 98 formed between the silencer 74 which is the guide portion of the printing machine and the guide plate 16 disposed in juxtaposed relation to the silencer 74. The sheet inserted in the gap 98 finds its way between the silencer 74 and a guide 99 of the printing machine 5.

The guide plate 16 is advantageously constructed such that it can be flipped upwardly for supplying sheets to the sheet feeding portion or carrying out maintenance and inspection of the parts. The guide plate 16 and outer guide plate 22 are provided with handles 21 and 22 respectively, to facilitate flipping of the plates 16 and 22.

The present device makes it possible to feed sheets either manually or automatically without moving any part of the apparatus or by a simple operation of flipping the outer guide plate upwardly.

Figure 9:
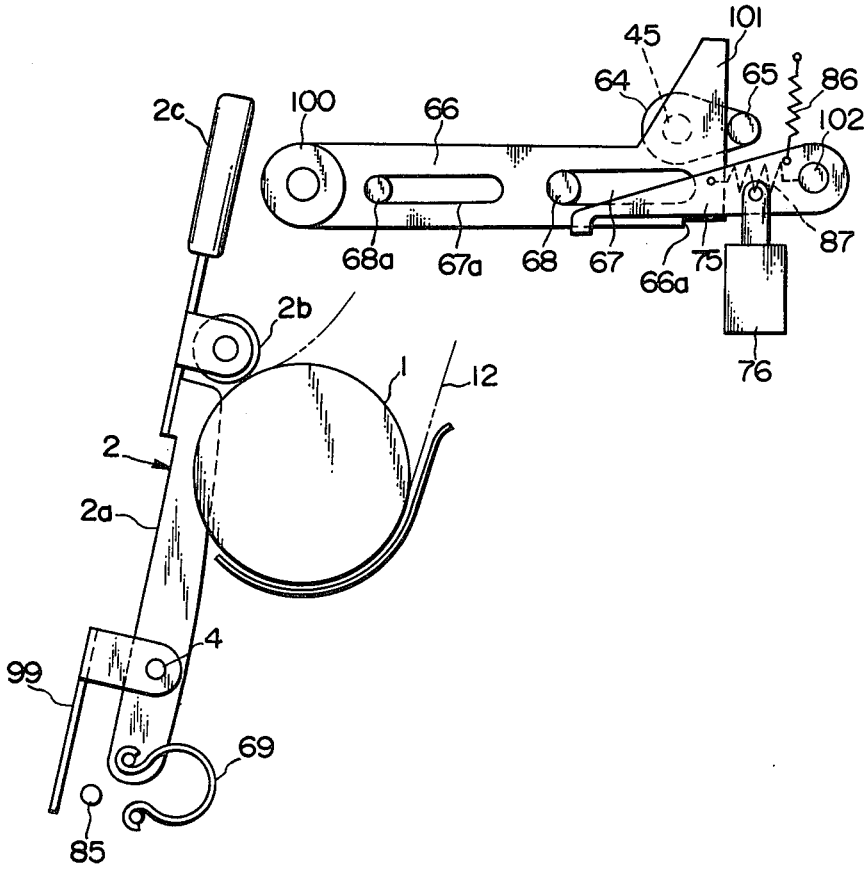
FIG. 9 is a side view of the system for actuating a paper bail according to an another embodiment of this device, showing the paper bail in its operative position.
Figure 10:
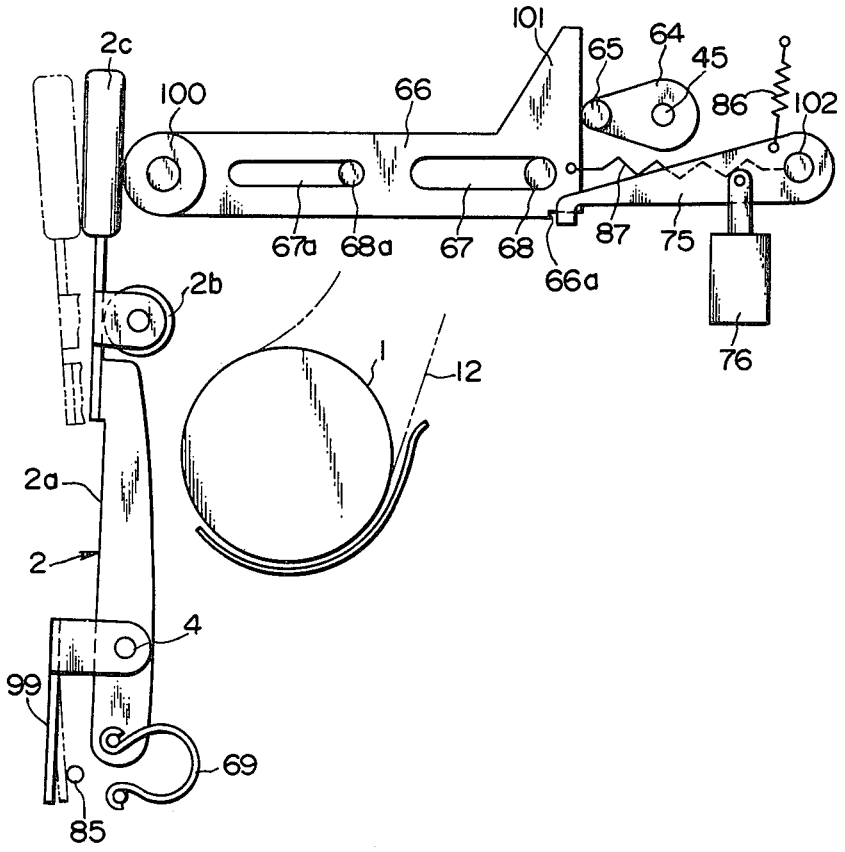
FIG. 10 is a view corresponding to FIG. 9 but showing the paper bail in its inoperative position.

In FIGS. 9 and 10, paper bail arms 2*a* supporting for rotation paper bail rollers 2*b* which are pressed against a platen 1 are supported by a shaft 4. The paper bail arms 2*a* each have a click spring 69 attached to one end thereof and a knob 2*c* attached to the other end thereof. A stopper 85 is provided for a stop lever 99 of the paper bail arm 2 to abut thereagainst to thereby limit the movement of the paper bail arms 2*a* away from the platen 1. The paper bail arms 2*a* are held by the action of the click springs 69 in one of an operative position in which the paper bail rollers 2*b* are positioned against the plate 1 and an inoperative position in which the rollers 2*b* are moved away from the platen 1, and are prevented from wobbling due to vibration or when a low force is exerted on the printing machine. The paper bail arms 2*a* may be of a known construction.

A lever 66 including an abutting end 100 slightly spaced apart from the knob 2*c* of the paper bail 2 in its operative position is guided in its reciprocating movement by the cooperation of slots 67 and 67*a* formed in the lever 66 and pins 68 and 68*a* received in the slots 67 and 67*a* respectively. The range of reciprocating movement of the lever 66 is restricted by the engagement of the pin 68 with ends of the slot 67. The lever 66 is formed at the other end with a cam follower 101 positioned against a crank pin 65. The lever 66 is urged by the biasing force of a spring 87 to abut against the crank pin 65 at all times. The crank pin 65 is mounted on a crank 64 supported by a shaft 45.

The rotation of the crank 64 caused by the rotation of the shaft 45 causes the lever 66 to be pushed by the crank pin 65 to move. At this time, the end 100 of the lever 66 pushes the knob 2*c*. The end 100 may be in the form of a roller rotatably supported by the lever 66 so as to avoid the exertion of an excess force on the knob 2*c* by the end 100.

One half revolution of the crank 64 pushes the lever 66 to the extreme left position in the drawings and moves the knob 2*c* and hence the paper bail arms 2*a* to an inclined position in which the arms 2*a* are slightly short of its inoperative position at the left in FIG. 2. The leftward position of the lever 66 is selected such that the click spring 69 is operative to restore the paper bail arms 2*a* to its operative position.

When the lever 66 reaches its leftward position, a latch 75 which is pivotally supported by a shaft 102 and under the action of a spring 86 is brought into engagement with an end 66*a* of the lever 66. Therefore, as the crank pin 65 is returned to its original position by another one half revolution of the crank 64, the lever 66 is held at its leftward position. The crank 64 stops after making one complete revolution and returns to its original position.

If a sheet 12 is inserted and stopped in a predetermined position, then a solenoid 76 is energized to tilt the latch 75 to disengage the same and release the lever 66. Thus the lever 66 is restored to its original position by the biasing force of the spring 87 in a short period of time. At this time, the paper bail arms 2*a* which are urged by the biasing force of the click spring 69 to press against the lever 66 also moves by following the lever 66, with the result that the paper bail arms 2*a* are automatically restored to the operative position in which the paper bail rollers 2*b* are positioned against the platen 1. Since the knob 2*c* is not restrained in any way by the lever 66 and merely pushed thereby to move to a released position, it is possible to manually actuate the paper bail arms 2*a* as in the prior art by manipulating the knob 2*c*, when the lever 66 is disposed in the standby position on the right side of FIG. 8. When manually operated, the paper bail arms 2*a* are moved to the inoperative position and held in said position by the click spring 69.

By rotating the crank 64 in synchronism with the feeding of the sheet 12 and by energizing the solenoid 76 with a predetermined timing with respect to the feeding of the sheet 12, it is possible to automatically effect switching of the paper bail 2 between the operative position and the inoperative position. And yet no restriction is placed on the manual operation of the paper bail 2.

This device enables automatic operation of a paper bail to be realized by merely additionally providing an attachment of simple construction to a conventional printing machine.

What is claimed is:

1. A printing machine comprising:

a platen for moving a sheet supplied thereto from the rear and above and wound thereon;

printing means for printing characters and symbols on the sheet wound on the platen;

a paper bail for pressing the sheet against the platen in a position slightly displaced from a printing position in a direction in which the sheet is delivered after a printing operation is performed on the sheet;

means for ejecting the sheet after a printing operation is performed thereon; and an automatic sheet feeding aparatus for automatically feeding sheets to the platen comprising sheet feeding means for feeding one sheet after another from a sheet supporting position, and a guide plate for guiding sheets to the platen, said sheet supporting position being capable of detachably mounting a cassette containing a plurality of sheets;

said sheet ejecting means comprising a guide plate for guiding a sheet from the platen to a sheet ejecting position, said guide plate being supported such that it can be opened and closed and defining, when brought to an open position, a cassette mounting opening through which the cassette can be inserted from the front of the printing machine to be mounted on the sheet supporting position;

said platen having attached thereto a guide portion for guiding a sheet ejected from the platen, and a gap defined between said guide portion and the guide plate of the sheet ejecting means for permitting one sheet after another to be inserted and fed toward the platen;

said paper bail comprising a paper bail arm supported for reciprocatorily moving the paper bail between an operative position in which a sheet is held against the platen by the paper bail and an inoperative position in which the sheet on the platen is released from engagement with the paper bail, a spring for pressing the paper bail into operative position by its biasing force, a lever supported for reciprocatory movement between an operative position in which the lever impinges on the paper bail arm and moves the paper bail to its inoperative position and an inoperative position in which it is moved away from the paper bail arm and permits the paper bail to remain in its operative position; and means for moving the lever in reciprocatory movement, said means for moving the lever in reciprocatory movement including a crank for urging the lever to move its operative position, a latch engaged for keeping the lever in its operative position, and means for releasing the latch.

2. A printing machine for printing on a sheet comprising:

a platen for moving a sheet supplied thereto and adapted to support this sheet as it is printed;

a paper bail engageable with said platen and adapted to hold the sheet against said platen as it is printed;

ejection means associated with said platen adapted for removing the sheet after it has been printed from said platen;

a cassette detachably mounted at a location spaced from said platen adapted to support a plurality of sheets;

means detachably mounting said cassette at the location spaced from said platen;

guide means disposed between said cassette and said platen and between said platen and said ejection means adapted for guiding a sheet supplied to and removed from said platen;

feed means associated with said cassette adapted to feed one sheet at a time from said cassette to said guide means; and a frame; said guide means movably mounted on said frame and movable into an inoperative position for defining an opening in said frame through which said cassette is inserted and detachably mounted at said location spaced from said platen and on said frame;

said guide means further comprising an inner guide plate pivotally mounted to said frame having a surface facing said feed means for receiving a sheet from said feed means and guiding it toward said platen;

said guide means further comprising an outer guide plate pivotally mounted to said frame and spaced from said inner guide plate having a surface adapted for guiding a sheet removed from said platen by said ejection means, said inner and outer guide plates being pivotable into an inoperative open position for defining said opening in said frame.

3. A printing machine for printing on a sheet comprising:

a platen movable for moving a sheet supplied thereto and adapted to support this sheet as it is printed;

a paper bail engageable with said platen and adapted to hold the sheet against said platen as it is printed;

ejection means associated with said platen adapted for removing the sheet after it has been printed from said platen;

a cassette detachably mounted at a location spaced from said platen adapted to support a plurality of sheets;

means detachably mounting said cassette at the location spaced from said platen;

guide means disposed between said cassette and said platen and between said platen and said ejection means adapted for guiding a sheet supplied to and removed from said platen;

feed means associated with said cassette adapted to feed one sheet at a time from said cassette to said guide means;

a frame; means connected to said frame and associated with said paper bail for disengaging said paper bail from said platen before a leading edge of the sheet reaches a position between the paper bail and the platen;

said means for disengaging said paper bail from said platen further comprise a lever slidably mounted on said frame, cam means connected to said frame and engaged with said lever for moving said lever against said paper bail, said paper bail comprising a pivotally mounted bail arm having a knob and a roller engageable with said platen, said lever movable against said knob for disengaging said roller from said platen, and said cam means being operatively connected to a motor through a one-rotation clutch means for enabling the cam means to be rotated by the motor when the paper bail should be brought out of engagement with the platen, so as to move the lever to release the paper bail from engagement with the platen;

latch means for locking said lever in a position in which said paper bail is disengaged from the platen; and means for unlatching said latch means when the paper bail should be brought into engagement with the platen.

4. A printing machine according to claim 3, further including biasing means connected to said bail arm for biasing said bail arm toward said platen and biased against the motion of said lever when it is operable to disengage said roller from said platen.

5. A printing machine for printing on a sheet comprising:

a platen movable for moving a sheet supplied thereto and adapted to support this sheet as it is printed;

a paper bail engageable with said platen and adapted to hold the sheet against said platen as it is printed;

ejection means associated with said platen adapted for removing the sheet after it has been printed from said platen;

a cassette detachably mounted at a location spaced from said platen adapted to support a plurality of sheets;

means detachably mounting said cassette at the location spaced from said platen;

guide means disposed between said cassette and said platen and between said platen and said ejection means adapted for guiding a sheet supplied to and removed from said platen;

feed means associated with said cassette adapted to feed one sheet at a time from said cassette to said guide means; and said cassette further including a handle member graspable to detach said cassette from said means detachably mounting said cassette, said handle member comprising a portion of said guide means for guiding the sheet from said cassette to said platen.

6. A printing machine comprising:

a platen for moving a sheet supplied thereto from the rear and above and wound thereon;

printing means for printing characters and symbols on the sheet wound on the platen;

a paper ball for pressing the sheet against the platen in a position slightly displaced from a printing position in a direction in which the sheet is delivered after a printing operation is performed on the sheet;

means for ejecting the sheet after a printing operation is performed thereon; and an automatic sheet feeding apparatus for automatically feeding sheets to the platen comprising sheet feeding means for feeding one sheet after another from a sheet supporting position disposed under said feeding means, and a lower guide plate for guiding sheets to the platen, said sheet supporting position being capable of detachably mounting a cassette containing a plurality of horizontally stacked sheets;

said sheet ejecting means comprising an upper guide plate for guiding a sheet from the platen to a sheet ejecting position, said lower and upper guide plates being supported such that they can be opened and closed and defining, when brought to an open position, a cassette mounting opening through which the cassette can be inserted in a rearward direction from the front of the printing machine to be mounted substantially horizontally on the sheet supporting position.

7. A printing machine according to claim 6, further including means detachably mounting said cassette at the location spaced from said platen;

a frame, said means detachably mounting said cassette connected to said frame and comprising resilient movement preventing means connected between said frame and said cassette, said means detachably mounting said cassette further including push up means associated with said cassette adapted for moving the plurality of sheets supported by said cassette toward said feed means; pg,32 said resilient movement preventing means further comprising a movement preventing roller rotatably mounted and resiliently movable on said frame, and a projection extending from said cassette and movable against said movement preventing roller to displace said movement preventing roller, said projection including an inclined surface abutted by said movement preventing roller for resiliently retaining said cassette on said frame.

8. A printing machine according to claim 6, wherein said platen has attached thereto a guide portion for guiding a sheet ejected from the platen, and a gap defined between said portion and the upper guide plate of the sheet ejecting means for permitting one sheet after another to be inserted through said gap and fed toward the platen.

* * * * *